United States Patent [19]

Strohmeyer, Sr.

[11] Patent Number: 4,852,688

[45] Date of Patent: Aug. 1, 1989

[54] COLLAPSIBLE LADDER ASSEMBLY

[76] Inventor: Robert W. Strohmeyer, Sr., 214 Bethel Rd., Mooresville, Ind. 46158

[21] Appl. No.: 211,820

[22] Filed: Jun. 27, 1988

[51] Int. Cl.[4] ..... E04C 1/56

[52] U.S. Cl. ..... 182/199; 182/70

[58] Field of Search ..... 182/196, 197, 198, 199, 182/76, 70

[56] References Cited

U.S. PATENT DOCUMENTS

| | | | |
|---|---|---|---|
| 406,257 | 7/1889 | Butler | 182/198 |
| 588,389 | 8/1897 | Boemmel | 182/198 |
| 1,053,135 | 2/1913 | Barron . | |
| 1,753,798 | 4/1930 | Martin . | |
| 2,102,484 | 12/1937 | Rapp | 182/199 |
| 3,344,886 | 10/1967 | Boscarino, Jr. . | |
| 3,415,341 | 12/1968 | Hostetler . | |
| 3,677,366 | 7/1972 | Loeffel . | |
| 3,692,145 | 9/1972 | Banner . | |
| 3,762,501 | 10/1973 | Probets . | |
| 3,847,246 | 11/1974 | Banner . | |
| 4,079,811 | 3/1978 | Driskell . | |
| 4,098,372 | 7/1978 | Luckey . | |
| 4,127,184 | 11/1978 | Strohmeyer | 182/196 |
| 4,260,039 | 4/1981 | Arato et al. . | |
| 4,434,871 | 3/1984 | Niedworok . | |
| 4,445,589 | 5/1984 | Longenecker . | |

*Primary Examiner*—Reinaldo P. Machado

*Attorney, Agent, or Firm*—Woodard, Emhardt, Naughton, Moriarty & McNett

[57] ABSTRACT

A collapsible ladder assembly for emergency exit from a building is secured to a window opening by a pair of anchoring hooks and includes two pairs of spaced-apart flexible rail members which support both a generally rectangular top step and a generally rectangular lower step at the four corners thereof. A plurality of intermediate rungs are supported by one of the pairs of rail members away from the building to provide for easier foot placement of the person descending the ladder. The top step defines a cavity for receipt of the rungs and the lower step in a stored condition.

28 Claims, 6 Drawing Sheets

COLLAPSIBLE LADDER ASSEMBLY

FIELD OF THE INVENTION

This invention relates to the field of collapsible ladders, and more particularly to a ladder stored in a small compact condition and deployable as a means of escape from an upper floor of a building in an emergency situation.

BACKGROUND OF THE INVENTION

The emergency or fire escape ladder art is replete with collapsible ladders deployable from a stacked, folded or telescopically nested storage condition interiorly or exteriorly below, between or in front of a window or other building opening. Of the many important features of a collapsible ladder, strength provides one unvarying parameter as the ladder must be capable of withstanding the weight of one or possibly several people at one time. The attempt to optimize other parameters such as cost, compactness of storage, ease of deployment and ease of descent has produced a wide variety of emergency ladders.

For example, U.S. Pat. No. 4,098,372 describes a collapsible ladder having flexible rail members and identically shaped rungs which seat upon one another and result in a very compact storage condition. Ladders of this type, although inexpensive and easy to deploy, are typically difficult to descend because the rungs hang so close to the building being exited that it is difficult for the climber to plant his feet firmly on the rungs. U.S. Pat. No. 1,053,135 discloses a fire escape ladder with a pair of flexible rail members and an outwardly extending step which is held away from the building and in a horizontal position by a pair of angled chain link sections. U.S. Pat. No. 1,753,798 shows a fire escape with a single pair of flexible rail members and horizontal rungs supported perpendicularly therebetween. U.S. Pat. No. 3,762,501 discloses a collapsible ladder assembly having a single pair of flexible rail members with vertically spaced rungs secured thereto and having disc members which are intended to space the ladder in use from the side of the building. U.S. Pat. Nos. 3,692,145 and 3,847,246 disclose escape ladders having horizontal support members which hold the rungs a distance from the building to provide stability for descent. U.S. Pat. No. 4,434,871 discloses an escape ladder having rungs with inward extensions to hold the rungs away from the wall of the building. U.S. Pat. Nos. 3,415,341 and 4,445,589 also disclose emergency fire escapes wherein each rung has inward extensions and wherein the rung is wide enough to provide a good wide tread for the climber's foot. U.S. Pat. No. 4,260,039 provides a collapsible ladder assembly having an accordion-like structure and wherein every other rung is substantially wider than the immediate rungs thereby providing adequate space for the climber's ft. U.S. Pat. Nos. 3,344,886 and 3,677,366 disclose additional fire escape devices deployable from an upper story window or similar emergency exit. Although many of the above ladders meet some of the important features such as ease of descent and ease of deployment, none satisfactorily meets all the desired features without being expensive, complicated or cumbersome.

What is needed is a collapsible ladder assembly which provides improved stability during descent while at the same time providing a small, inconspicuous storage size and which is easy to deploy in an emergency.

SUMMARY OF THE INVENTION

Generally speaking, a collapsible ladder assembly is provided for deployment from an emergency exit of a building for egress during an emergency situation.

In one embodiment of the invention, the ladder is fully portable and is anchored to a window ledge or similar structure by a pair of hooks. Two pairs of spaced-apart flexible rail members are connected at their top ends to the anchor hooks. In the deployed condition, one of the spaced-apart pair of rail members extends from the anchor hooks vertically downward, adjacent the building and extends to and supports the back side or building side of a rectangular top step and extends therefrom to support the back side or building side of a rectangular lower step. The second pair of rail members extends from the pair of building hooks to support the front side of the top step and, vertically therebelow, to the front side of the lower step. The first and second pair of rail members cooperatively support the top step and the lower step in a substantially horizontal position. A plurality of generally tubular rungs are supported by the second pair of rail members in spaced-apart relation between the top step and the lower step. An additional plurality of generally tubular rungs are also supported by the second pair of rail members in spaced-apart relation below the lower step. The resulting ladder assembly hangs with rungs which are spaced sufficiently from the building to permit the feet to be more easily placed upon the rungs.

In another embodiment, the collapsible ladder assembly is anchored inside of and to the floor of the building just below the emergency exit. A storage case and lid is provided for receipt of the ladder assembly in the storage condition. Deployment of the ladder in an emergency situation is done by merely removing the ladder from the enclosure and tossing it out the exit.

In another embodiment, the collapsible ladder assembly is combined with an ornamental plant box and includes an anchor rail attached to the exterior of the building just below the emergency exit. A frame is supported by the anchor rail and holds a top rung of the ladder outwardly from the wall. In the deployed condition, one pair of spaced-apart flexible rail members hangs from the anchor rail vertically downward, adjacent the building and extends to and supports the back side or building side of a rectangular top step and extends therefrom to support the back side or building side of a rectangular lower step. A second pair of rail members extends from the anchor rail downwardly and outwardly to the top rung and therefrom extends vertically downward to support the front side of the top step and vertically therebelow, to the front side of the lower step. The first and second pair of rail members cooperatively support the top step and lower step in a substantially horizontal position. A plurality of generally tubular rungs are supported by the second pair of rail members in spaced-apart relation between the top rung and the top step. An additional plurality of generally tubular rungs are supported by the second pair of rail members in spaced-apart relation between the top step and the lower step, while an additional plurality of generally tubular rungs are also supported by the second pair of rail members in spaced-apart relation below the lower step. The second pair of rail members extends below the lowermost rungs and are attached to a window box cover. The cover holds the plurality of rungs and the steps in an orderly arrangement between itself and the frame in the storage condition.

It is an object of the present invention to provide an improved collapsible ladder assembly.

It is another object of the present invention to provide a collapsible ladder assembly which is easy to descend.

It is still another object of the present invention to provide a collapsible ladder assembly which is compact and lightweight in storage, yet which is easily deployed in an emergency situation.

Other objects and advantages of the present invention will become apparent from the following description.

DESCRIPTION OF THE PREFERRED EMBODIMENT

Figure 1:
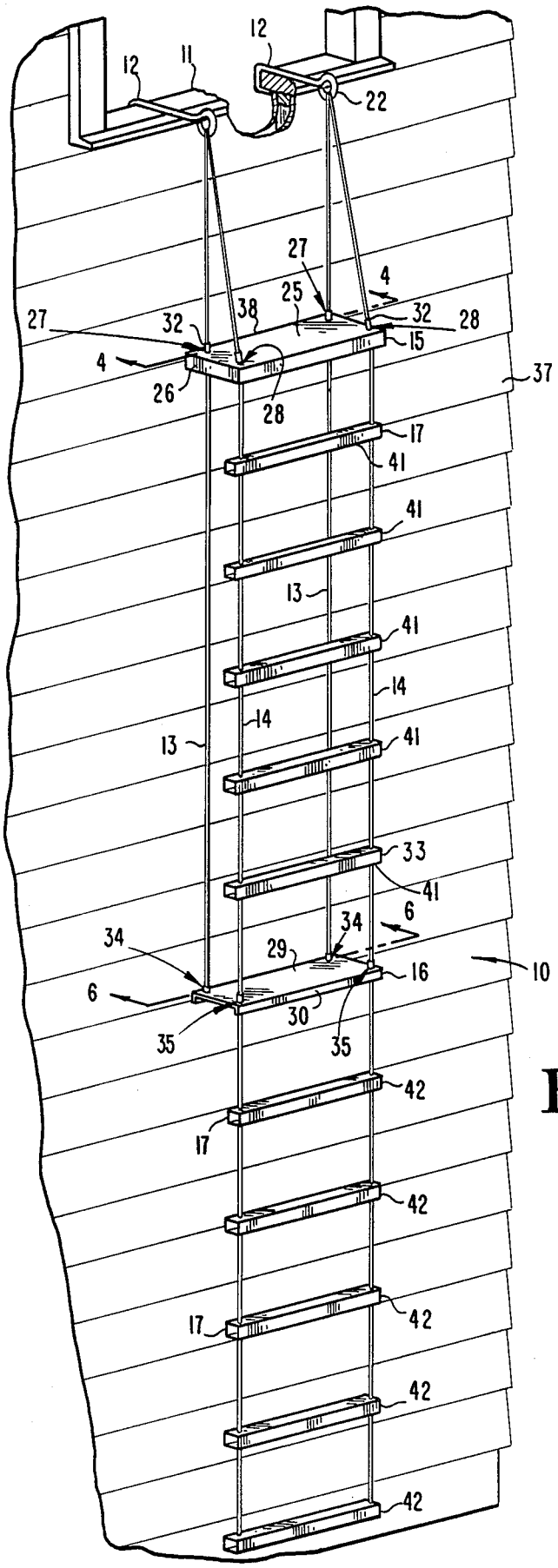
FIG. 1 is a perspective view of the collapsible ladder assembly in accordance with the preferred embodiment of the present invention and shown in the fully deployed condition.

For the purposes of promoting an understanding of the principles of the invention, reference will now be made to the embodiment illustrated in the drawings and specific language will be used to describe the same. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is shown a collapsible ladder assembly 10 in the deployed condition in accordance with the preferred embodiment of the present invention. Ladder assembly 10 of the present embodiment is a portable assembly and can be deployed from an appropriate ledge 11 and hang therefrom a vertical distance of approximately 13 feet.

Figure 2:
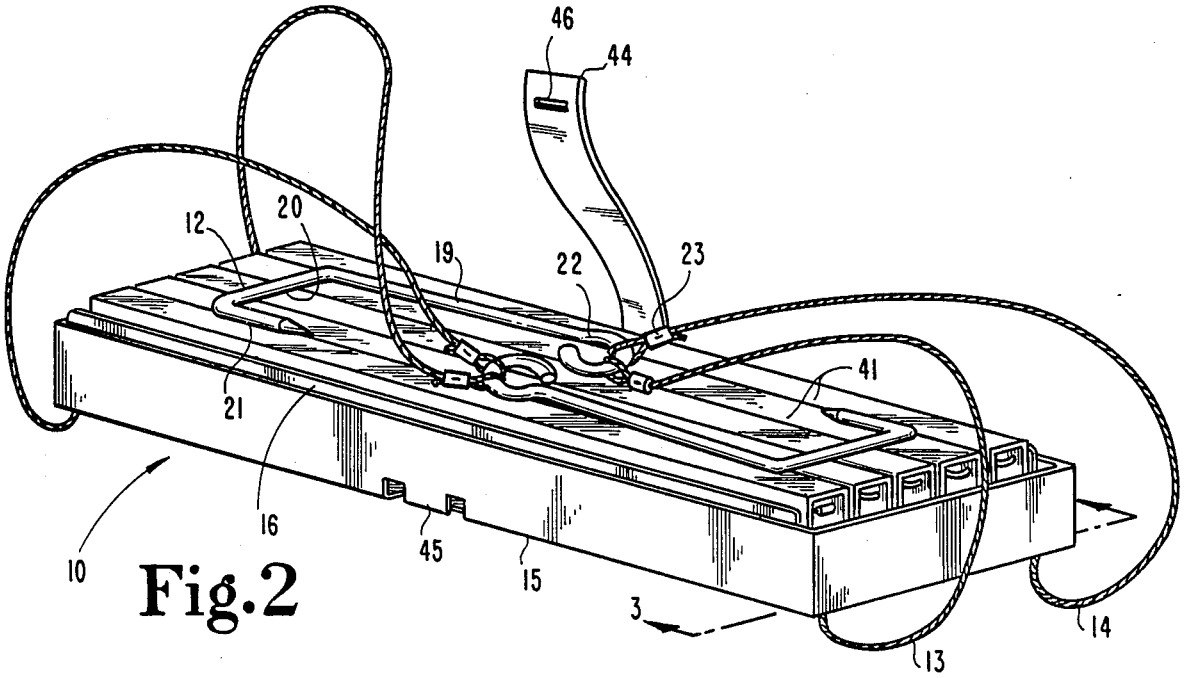
FIG. 2 is a perspective view of the collapsible ladder assembly of FIG. 1 shown substantially in the stored condition.

Ladder assembly 10 generally includes anchoring means (which are a pair of anchor hooks 12), a first pair of flexible rail members 13, a second pair of flexible rail members 14, a top step 15, a lower step 16 and a plurality of identical rungs 17. Each hook 12 has a shank portion 19, a gripping portion 10, a barb portion 21 and an eyelet 22 (FIG. 2). The dimensions of shank portion 19, gripping portion 20 and barb portion 21 are such that anchor hooks 12 can easily grapple onto any standard window sill. Rungs 17, top step 15 and lower step 16 are supported in vertically spaced-apart relation by first pair of spaced-apart inside flexible rail members 13 and by second pair of spaced-apart outside flexible rail members 14. One end of each of the four rail members is looped through the eyelets 22 of anchor hooks 12 and secured thereto by appropriate clamps 23 (FIG. 2). As shown in FIG. 1, one of the pair of rail members 13 and one of the pair of rail members 14 is secured to one of the pair of anchor hooks 12 while the other of each pair of rail members 13 and 14 is secured to the other of the anchor hooks 12.

Figure 5:
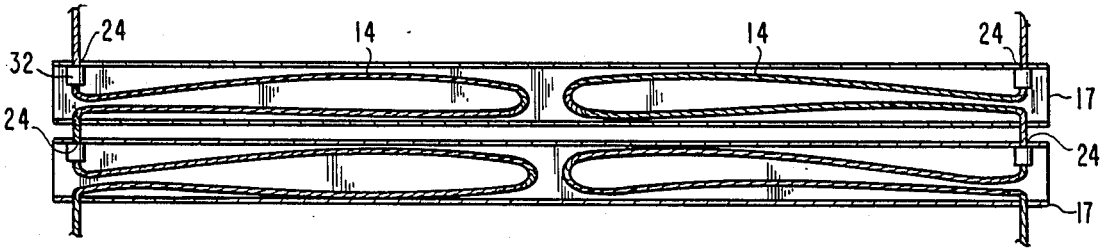
FIG. 5 is an enlarged top cross-sectional view of two of the rungs of the ladder assembly of FIG. 2 showing the storage position of the flexible rail members.
Figure 6:
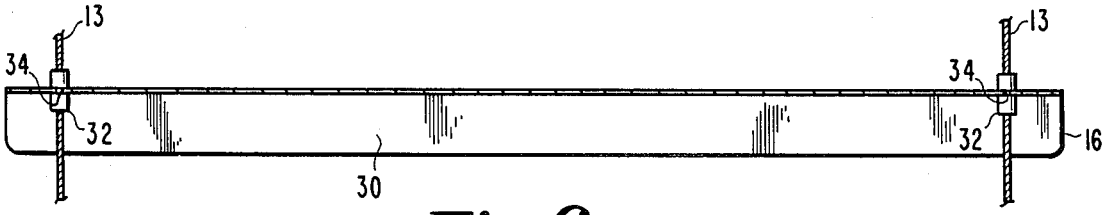
FIG. 6 is an enlarged cross-sectional view of the lower step of the ladder assembly of FIG. 1 taken along the lines 6—6 and viewed in the direction of the arrows.

To provide for ease of stacking and storing, rungs 17 are right rectangular cylindrical tubes. As shown in FIG. 5, each rung 17 is provided with a pair of opposing holes 24 adjacent each end thereof for receiving rail members 13 and 14. Top step 15 has a flat rectangular portion 25 and depending orthogonal sides 26 which form an open right rectangular tray for receiving lower step 16 and rungs 17 nested therein in the stored condition (FIG. 2) and which, when inverted, form a stable, downwardly opening top step for ladder assembly 10. Top step 15 is provided with four holes, two adjacent inside holes 27 and two adjacent outside holes 28, all in top portion 25 and each adjacent one of the four corners for receipt of rail members 13 and 14 therethrough. Lower step 16 likewise has a flat, rectangular top portion 29 and a pair of opposing sides 30 to form a U-shaped tray for receiving, in the stored condition, the rungs which hang therebelow in the deployed condition. Lower step 16 is provided with four holes, two adjacent inside holes 34 and two adjacent outside holes 35, all in top portion 29, and each adjacent one of the four corners for receipt of rail members 13 and 14 therethrough.

Figure 4:
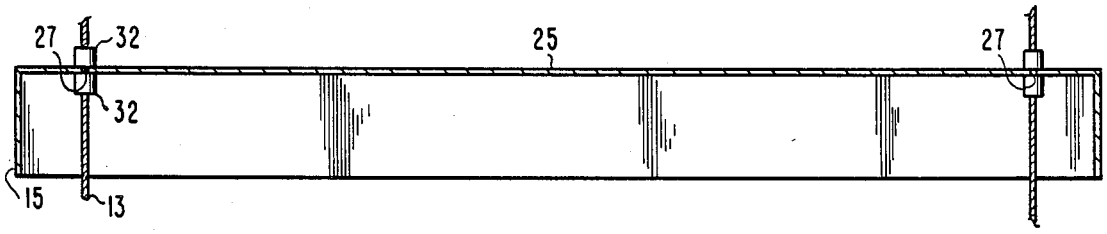
FIG. 4 is an enlarged cross-sectional view of the top step of FIG. 1 taken along the lines 4—4 and viewed in the direction of the arrows.

Each rail member 13 extends from its attachment at an anchor hook 12 through a corresponding one of the two inside holes 27 of top plate 15. From there, each rail member 13 extends to lower step 16 and through the corresponding one of the two inside holes 34. Top step 15 is fixedly held at the desired vertical position along rail members 13 by cable clamps 32 both above and below top portion 25 (FIG. 4). Each cable clamp 32 is appropriately fixed in place on the rail member, as by crimping, and has a diameter larger than that of its corresponding adjacent hole to prevent travel of the corresponding rail member through its respective hole. A pair of cable clamps 32 are also provided to each rail member 13 above and below top portion 29 of lower step 16 to hold step 16 at the desired vertical position along rail members 13. Each rail member 14 extends from its attachment at a respective anchor hook 12 to and through the corresponding two outside holes 28. From there, each rail member 14 extends to and through the respective opposing holes 24 of each of five successive upper rungs 41. After exiting the fifth (33) of these rungs, each rail member 14 extends to and through the corresponding two outside holes 35 of lower step 16. From lower step 16, each rail member 14 extends to and through the respective opposing holes 24 of each of five successive lower rungs 42 which hang below lower step 16. As with rail members 13, top step 15 and lower step 16 are held at the desired vertical position along rail members 14 by cable clamps 32. Each of the ten rungs 17 are likewise held in the desired vertically spaced-apart position along rail members 14 by cable clamps 32. As shown in FIG. 5 and in FIG. 1 at 39, cable clamps 32 are placed about rail members 14 at points inside hollow rungs 17 and between the opposing holes 24.

The deployment of ladder assembly 10 and securement of anchor hooks 12 to a building 37 is usually such that eyelets 22 are nearly in line with the vertical face of the building. Cable clamps 32 are therefore placed on rail members 13 and rail members 14 so that, in the deployed condition shown in FIG. 1, top step 15 hangs in a position perpendicular to building 37 with the back edge 38 of top plate 15 resting against building 37. Cable clamps are likewise affixed to rail members 13 and 14 so that lower step 16 hangs perpendicularly to building 37 when in the deployed condition. With top step 15 and lower step 16 hung in this manner, all ten vertically spaced-apart rungs 17 are supported upon rail members 14 away from building 37. This allows a person descending ladder assembly 10 to easily position each foot wall onto a rung without his or her toe hitting building 37 and allowing only placement of the front portion of the foot onto a rung.

Figure 3:
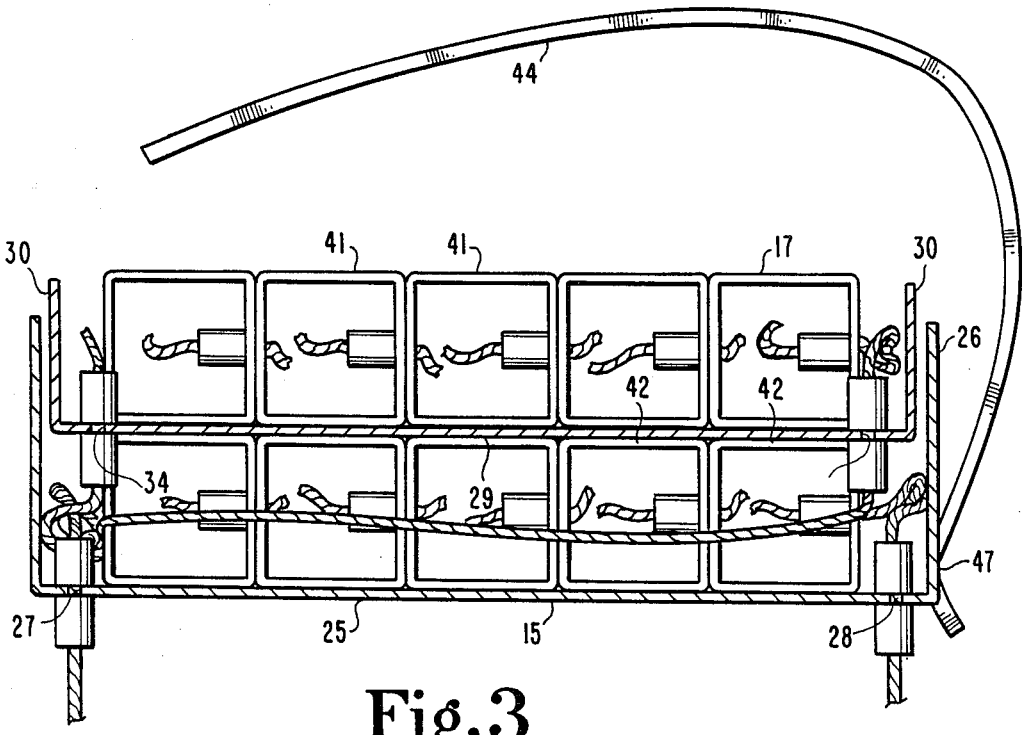
FIG. 3 is an enlarged cross-sectional view of the ladder assembly of FIG. 2 taken along the lines 3—3 and viewed in the direction of the arrows.

In the stored condition shown in FIGS. 2, 3 and 5, top step 15 serves as a tray for orderly, nested receipt of lower step 16 and all ten rungs 17. The five upper rungs 41 are stacked adjacent each other, with rail members 14 drawn and stored within the hollow core of each rung 17 (FIG. 5), and laid adjacent top portion 25 within the cavity of top step 15. The five lower rungs 42 are similarly stacked and laid within lower step 16, all of which (rungs 17 and lower step 16) is then laid on top of and adjacent the stacked upper five rungs 41. Rail members 13 are coiled as space permits within top step 15 and around rungs 17 and lower step 16. The remaining length of rail member 13 and 14 (between anchor hooks 12 and top step 15), along with anchor hooks 12, are appropriately coiled and laid atop the stacked lower five rungs 42. Lower step 16, rungs 17, rail members 13 and 14, and anchor hooks 12 are held firmly in position within top step 15 by an easily removable elastic strap 44. Strap 44 has a slot 46 at each end which engages with a tab 45 cut into each side of top step 15. After all the elements of ladder assembly 10 are stacked as shown in FIGS. 2 and 3, one slot 46 is slipped over one tab (at 47 in FIG. 3) and strap 44 is stretched over assembly 10 while the other slot 46 is slipped over the other tab 45, trapping lower step 16, rungs 17, rail members 13 and 14, and anchor hooks 12 between it and top step 15.

In one embodiment constructed, hooks 12 were formed from three-eights inch diameter stock. Rungs 17 were made from one inch square 14 gauge aluminum tubing. The length of each rung 17 was about $16\frac{1}{2}$ inches. Lower step 16 was formed from 14 gauge aluminum and measured about $17\frac{1}{2} \times 5\frac{3}{4}$ inches with sides 30 having a depth of about one inch. Top step 15 was formed from 12 gauge aluminum and measured about $18 \times 6$ inches with sides 26 having a depth of about two inches. Rail members 13 and 14 were made of woven wire rope. In the deployed condition (FIG. 1), the vertical distance from eyelets 22 to top step 15 was about two feet. The total deployed height from eyelets 22 to the lowermost rung 48 was about 13 feet. In the stored condition (FIG. 2). and with strap 44 firmly securing all components nested within top step 15, ladder assembly 10 measured approximately $18 \times 6 \times 3$ inches and weighed about 8 pounds. The resulting ladder assembly 10 was light, compact and easily stored under a bed or in a closet. In an emergency, elastic strap 44 is easily removed, anchor hooks 12 positioned about the ledge of the emergency exit and the remainder of ladder assembly 10 is dropped out the exit. The weight of the components of assembly 10 will draw rail members 14 from their storage position within each rung until assembly 10 is in the fully deployed condition of FIG. 1.

Figure 7:
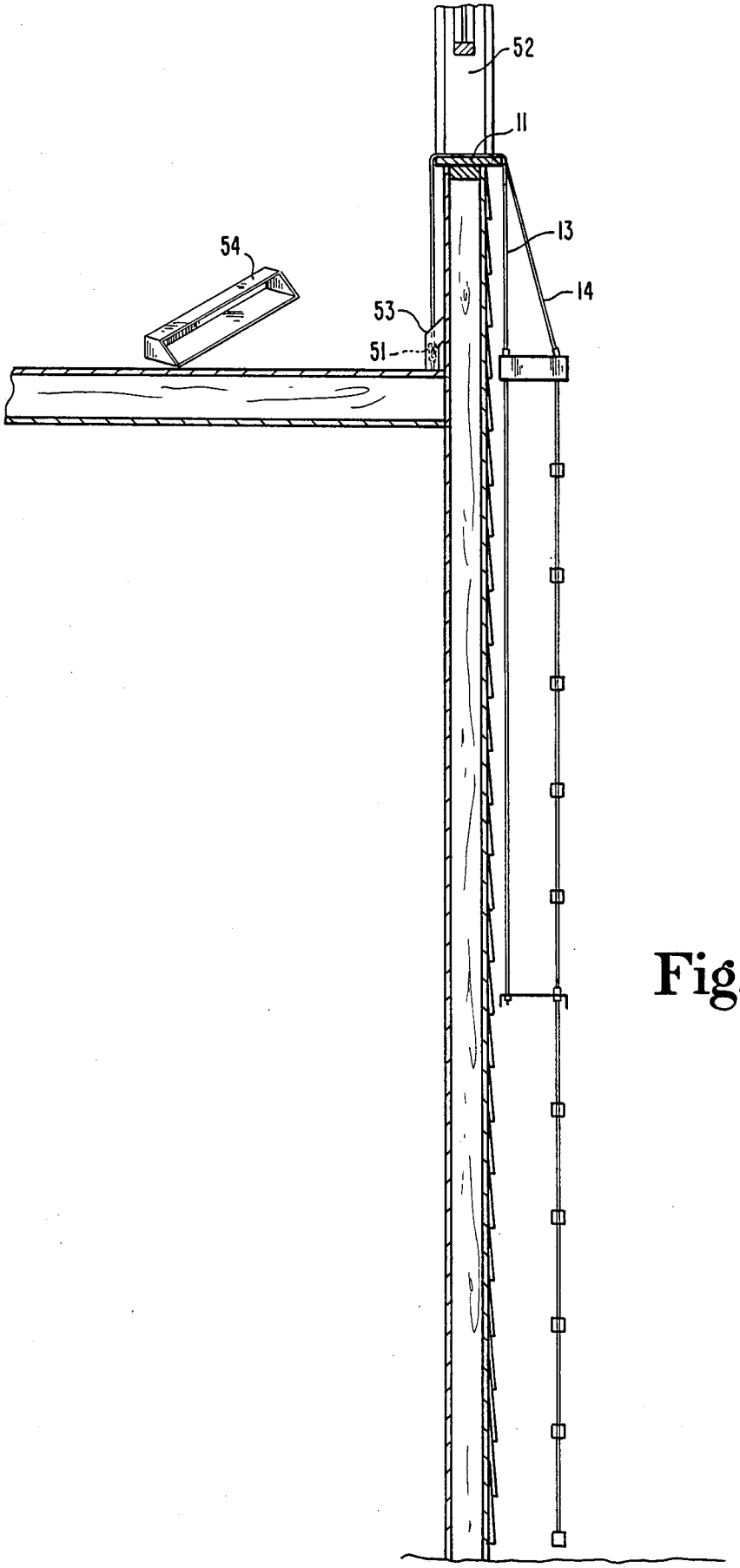
FIG. 7 is a side cross-sectional view of the collapsible ladder assembly in accordance with an alternative embodiment of the present invention and shown in the fully deployed condition.
Figure 8:
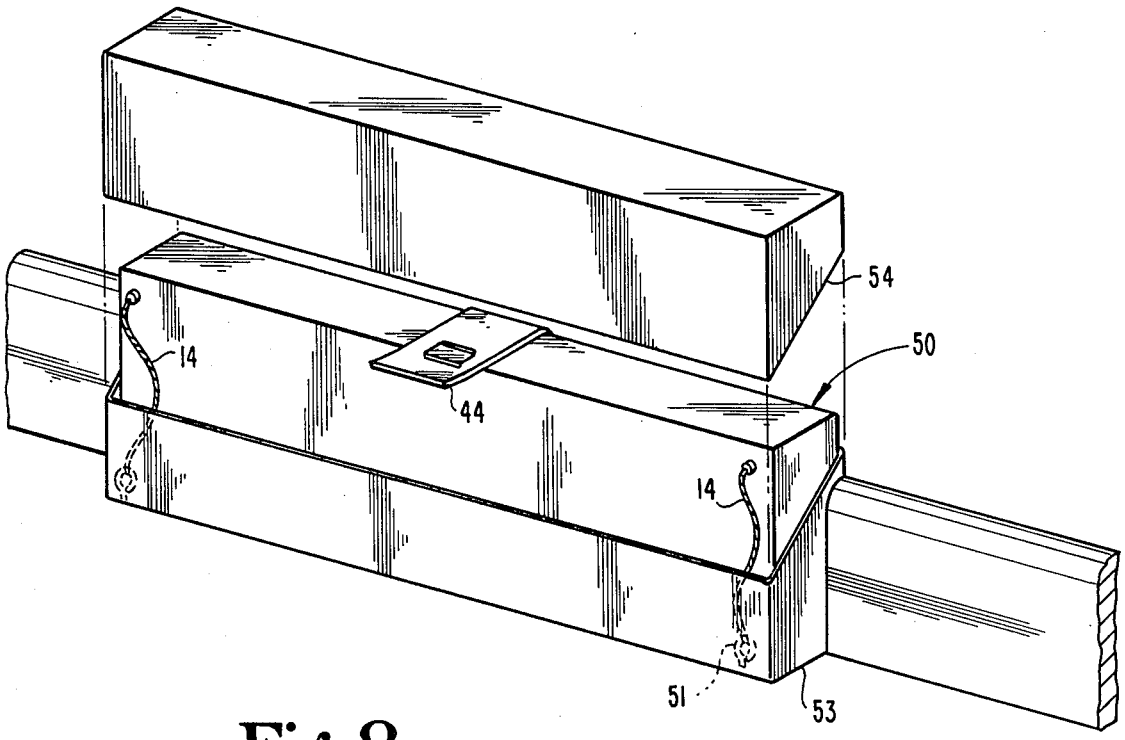
FIG. 8 is a perspective view of the ladder assembly of FIG. 7 shown in the stored condition.

In an alternative embodiment shown in FIGS. 7 and 8, anchor hooks 12 are replaced with screw eyes 51 which are secured to the floor, inside the building and just below the emergency exit 52. A storage case 53 and lid 54 are provided at the intersection of the floor and wall. In the storage condition (FIG. 8), ladder assembly 50 includes the same elements as and is packed the same as ladder assembly 10 of FIG. 2 except that there are no anchor hooks. The rail members are instead secured to screweyes 51 and the length of rail members 13 and 14 between screweyes 51 and top step 15 is greater so that top step 15 hangs about two feet below window ledge 11 in the deployed condition as shown in FIG. 7. To deploy ladder assembly 50, lid 54 is removed, assembly 50 is lifted out of case 53, strap 44 is removed and assembly 50 is literally tossed out exit 52. Ladder assembly 50 will open automatically under its own weight into the deployed condition of FIG. 7.

In other embodiments fewer than five rungs may be used below a particular step. Also, additional steps may be used. For example, another step may be added below the last rung 42 of FIG. 1 with all four rail members 13 and 14 being extended appropriately to support it. If desired, additional rungs may be added therebelow, the additional rungs being supported by extending rail members 14 appropriately downward. The remainder of ladder assembly 14 would be constructed as described above to accommodate the slightly larger storage size. For example, sides 26 of top step 15 would be slightly larger to receive the additional step and/or rungs.

Figure 9:
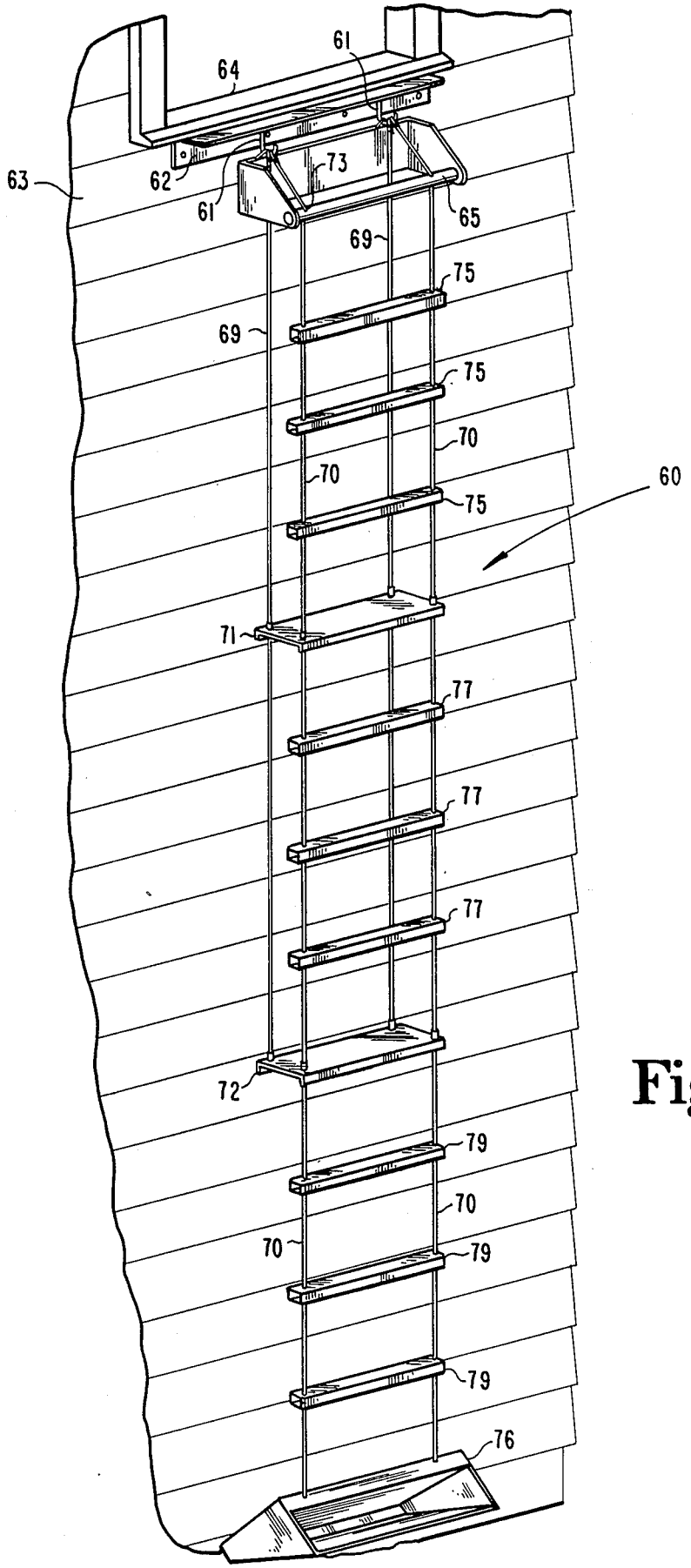
FIG. 9 is a perspective view of the collapsible ladder assembly in accordance with an alternative embodiment of the present invention and shown in the fully deployed condition.

In another embodiment shown in FIG. 9, the anchoring means of ladder assembly 60 is incorporated into a flower box assembly as disclosed in U.S. Pat. No. 4,127,184 which is hereby incorporated by reference. Instead of being a portable device being hung from an emergency exit by anchor hooks 12 as shown in FIG. 1 above, ladder assembly 60 of FIG. 9 is supported by a pair of hooks which are secured to anchor rail 62 which is fixedly mounted to building 63 just below emergency exit 64. A top rung (spacing means) 65 is secured to a top rung support frame 66 which is supported in an appropriate manner from hooks 61. Top rung 65 is thereby held approximately 6 inches away from building 63. In the deployed condition, a first pair of spaced-apart flexible rail members 69 is secured at the upper ends of each rail member to hooks 61 and hangs vertically downward therefrom, adjacent the building. From hooks 61, rail members 69 extend to and support the backside or building side of a rectangular top step 71 and extend therefrom to support the backside or building side of a rectangular lower step 72. A second pair of spaced-apart flexible rail members 70 is connected at upper ends to hooks 61. Rail members 70 extend therefrom outwardly and downwardly to and through holes 73 in top rung 65. From top rung 65, rail members 70 extend vertically downward to support the front side of top step 71 and extend therefrom vertically downward to support the front side of lower step 72. With rail members 70 being supported away from the building by top rung 65, rail members 69 and 70 cooperatively support top step 71 and lower step 72 in a substantially horizontal position. A first set of three generally tubular rungs 75 are supported by rail member 70 in spaced-apart relation between top rung 65 and top step 71. A second set of three generally tubular rungs 77 are supported by rail member 70 in spaced-apart relation between top step 71 and lower step 72, while a third set of three generally tubular rungs 79 are supported by rail members 70 in spaced-apart relation below lower step 72. Rail members 70 extend below the lowermost rungs and are attached to a window box cover 76. In the deployed condition, the width of cover 76 helps hold rail members 70 and rungs 79 away from building 63 while the person is descending ladder assembly 60. In the stored condition, cover 76 holds the rungs 75, 77 and 79 in an orderly arrangement between itself and frame 66. As disclosed in U.S. Pat. No. 4,127,184, when necessary, window box cover 76 may be quickly and easily released from its position in a storage condition adjacent top rung support frame 66, whereby the weight of cover 76 falling away from support frame 66 aids to deploy ladder assembly 60. Although the embodiment shown in FIG. 9 shows an assembly with three rungs spaced above or below steps 71 and 72, other combinations of rungs and steps may be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A collapsible ladder assembly for deployment from an emergency exit of a building, comprising: 'anchoring means for anchoring the ladder assembly to the building;

a first pair of flexible rail members connected at one end to said anchoring means;

a second pair of flexible rail members connected at one end to said anchoring means;

a top step having a back edge and an opposite front edge, said first pair of rail members being connected to said top step at spaced-apart points adjacent the back edge, said second pair of rail members being connected to said top step at spaced-apart points adjacent the front edge, and said top step being supported by all of said rail members to extend substantially perpendicularly in relation thereto in a deployed condition;

at least one lower step having a back edge and an opposite front edge, said first pair of rail members being connected to said lower step at spaced-apart points adjacent the back edge, said second pair of rail members being connected to said lower step at spaced-apart points adjacent the front edge, and said lower step being supported by all of said rail members to extend substantially perpendicularly in relation thereto in the deployed condition;

a plurality of upper rungs supported by said second pair of rail members to extend generally perpendicularly therebetween in vertically spaced-apart relation between said first step and said lower step in the deployed condition; and wherein said top step is generally rectangular and defines a cavity for nested receipt of said lower step and said plurality of upper rungs in a stored condition.

2. The collapsible ladder assembly of claim 1 further including a plurality of lower rungs supported by said second pair of rail members to extend generally perpendicularly therebetween in vertically spaced-apart relation below said lower step wherein said plurality of upper rungs and said plurality of lower rungs are supported to hang away from the building and wherein the cavity of said top step is adapted to further receive said plurality of lower rungs nested therewithin.

3. The collapsible ladder assembly of claim 1 wherein all of said rungs are tubular.

4. The collapsible ladder assembly of claim 3 wherein the stored condition includes said plurality of upper rungs being stacked adjacent each other with a portion of each of said second pair of rail members stored within each of said plurality of upper rungs and includes said plurality of lower rungs being stacked adjacent each other with a portion of each of said second pair of rail members stored within each of said plurality of lower rungs.

5. The collapsible ladder assembly of claim 1 wherein the ladder assembly is completely portable.

6. The collapsible ladder assembly of claim 5 wherein said anchoring means is a pair of hooks.

7. The collapsible ladder assembly of claim 1 further including a plurality of top rungs supported by said second pair of rail members to extend generally perpendicularly therebetween in vertically spaced-apart relation above said top step and wherein said plurality of top rungs and said plurality of upper rungs are supported to hang away from the building.

8. A collapsible ladder assembly for deployment from an emergency exit of a building, comprising:

anchoring means for anchoring the ladder assembly to the building;

a first pair of flexible rail members each connected at one end to said anchoring means;

a second pair of flexible rail members each connected at one end to said anchoring means;

a top step having a top portion and sides defining a downwardly facing cavity for receiving rungs nested therein in a stored condition, said top step being supported by both said first and second pairs of rail members to extend generally perpendicularly therebetween in a deployed condition;

at least one lower step having a top portion and being supported by both said first and second pairs of rail members to extend generally perpendicularly therebetween and below said first step in the deployed condition; and, a plurality of rungs supported by said second pair of rail members to extend generally perpendicularly therebetween in spaced-apart relation between said first step and said lower step in the deployed condition.

9. The collapsible ladder assembly of claim 8 wherein the deployed condition includes:

said first pair of rail members supporting said top step at a pair of spaced-apart points near the building, said second pair of rail members supporting said top step at a pair of spaced-apart points away from the building, said first pair of rail members supporting said at least one lower step at a pair of spaced-apart points near the building, and said second pair of rail members supporting said at least one lower step at a pair of spaced-apart points away from the building.

10. The collapsible ladder assembly of claim 9 wherein said at least one lower step defines a downwardly facing cavity for receiving rungs nested therein in a stored condition and wherein the ladder assembly further includes at least one lower rung supported by said second pair of rail members to extend, in the deployed condition, generally perpendicularly therebetween and below said at least one lower step.

11. The collapsible ladder assembly of claim 10 wherein the stored condition includes said plurality of rungs being nested within the cavity of said top step adjacent the top portion and said at least one lower step being at least partially nested within the cavity of said top step adjacent said plurality of rungs and said at least one rung being nested within the cavity of said at least one lower step.

12. The collapsible ladder assembly of claim 11 further including releasable means for holding the ladder assembly in the stored condition.

13. The collapsible ladder assembly of claim 11 wherein there are at least four of said plurality of rungs and wherein said plurality of rungs stack side by side one another in the cavity of said top step in the stored condition.

14. The collapsible ladder assembly of claim 11 wherein each of said plurality of rungs and said at least one rung has a hollow tubular cross-section having at least one side wall defining a pair of opposed passageways, and wherein each of said second pair of rail members passes through a corresponding one of the pair of opposed passageways, and wherein the ladder assembly further includes a plurality of cable clamps, one attached to each flexible rail member adjacent each at least one side wall to fix the positions of each of said plurality of rungs and said at least one rung vertically on said second pair of flexible rails.

15. The collapsible ladder assembly of claim 14 wherein the majority of length of said second pair of rail members is stored within the hollow tubular cross-section of said plurality of rungs and said at least one rung in the stored condition.

16. The collapsible ladder assembly of claim 9 wherein said top step and said at least one lower step are each at least two times wider than each of said plurality of rungs.

17. The collapsible ladder assembly of claim 11 wherein said anchoring means is a pair of hooks engageable with the building near the emergency exit.

18. The collapsible ladder assembly of claim 8 further including a plurality of top rungs supported by said second pair of rail members to extend generally perpendicularly therebetween in vertically spaced-apart relation above said top step.

19. The collapsible ladder assembly of claim 8 wherein said anchoring means includes a pair of hooks adapted to engage a window ledge.

20. The collapsible ladder assembly of claim 8 wherein said anchoring means includes permanent anchors screwed to a wall surface near the building exit.

21. A collapsible ladder assembly for deployment from an emergency exit of a building, comprising:

anchoring means for anchoring the ladder assembly to the building;

a first pair of flexible rail members each connected at one end to said anchoring means;

a second pair of flexible rail members each connected at one end to said anchoring means;

a top step and at least one lower step supported by both said first and second pair of rail members;

at least one rung supported by said second pair of rail members;

wherein the ladder assembly has a deployed condition wherein both said top step and said lower step are supported by said first and second pairs of rail members at mutually spaced apart points on said top step and on said lower step and are supported thereby in a substantially horizontal position and wherein said at least one rung is supported by said second pair of rail members in vertically spaced-apart relation between said top step and said lower step; and wherein said top step defines a cavity and wherein said ladder assembly has a stored condition wherein said cavity receives said lower step and said at least one rung nested therein.

22. The collapsible ladder assembly of claim 21 wherein there are a plurality of rungs, wherein some of said rungs are supported in vertically spaced-apart relation by said second pair of rail members between said top step and said lower step and wherein other of said rungs are supported in vertically spaced-apart relation below said lower step, all of said rungs being supported away from the building.

23. A collapsible ladder assembly for deployment from an emergency exit of a building comprising:

anchoring means for anchoring the ladder assembly to the building;

a first pair of flexible rail members connected at one end to said anchoring means;

a second pair of flexible rail members connected at one end to said anchoring means;

spacing means near said anchoring means for spacing said second pair of rail members away from the building;

at least one lower step defining a cavity for nested receipt of rungs and steps in a stored condition, said lower step supported by both said first and second pairs of flexible rail members to extend substantially perpendicularly therebetween; and at least one rung supported by said second pair of rail members to extend generally perpendicularly therebetween and below said at least one lower step in the deployed condition.

24. The collapsible ladder assembly of claim 23 further including a plurality of upper rungs supported by said second pair of rail members to extend generally perpendicularly therebetween in vertically spaced-apart relation between said spacing means and said at least one lower step in the deployed condition.

25. The collapsible ladder assembly of claim 23 further including a cover adapted to receive and cover said at least one lower step, said at least one rung and said spacing means and adapted to be supported by said anchoring means in the stored condition, said cover supported in the deployed condition by said second pair of rail members below all of said steps and rungs.

26. The collapsible ladder assembly of claim 25 wherein said cover is a flower box cover.

27. The collapsible ladder assembly of claim 25 further including, in the deployed condition, a plurality of upper rungs supported by said second pair of rail members to extend generally perpendicularly therebetween in vertically spaced-apart relation between said spacing means and said at least one lower step, at least one additional lower step supported by both said first and second pairs of rail members to extend substantially perpendicularly therebetween and below said at least one lower step.

28. The collapsible ladder assembly of claim 23 further including a plurality of lower rungs supported by said second pair of rail members to extend generally perpendicularly therebetween in vertically spaced-apart relation below said at least one lower step in the deployed condition.

* * * * *

UNITED STATES PATENT AND TRADEMARK OFFICE

CERTIFICATE OF CORRECTION

PATENT NO. : 4,852,688

DATED : August 1, 1989

INVENTOR(S) : Robert W. Strohmeyer, Sr.

It is certified that error appears in the above-identified patent and that said Letters Patent is hereby corrected as shown below:

In column 1, line 24, after "emergency" please insert --escape--.

In column 1, line 58, please change "the immediate" to --intermediate--.

In column 1, line 59, please change "ft." to --feet--.

In column 2, line 55, after "and" please insert a comma.

In column 3, line 41, "FIG. 9" should begin a new paragraph.

In column 4, line 3, please change "10" to --20--.

In column 5, line 23, please change "wall" to --well--.

In column 5, line 53, please change "three-eights" to --three-eighths--.

In column 5, line 66, please change the second period to a comma.

In column 7, line 39, please delete the single quote and begin a new paragraph with "anchoring means".

In column 8, line 9, please insert a comma after "step".

In column 10, line 35, please insert a comma after "building".

Signed and Sealed this

Nineteenth Day of June, 1990

*Attest:*

HARRY F. MANBECK, JR.

*Attesting Officer*

*Commissioner of Patents and Trademarks*